US011617052B2

(12) United States Patent
Choi et al.

(10) Patent No.: US 11,617,052 B2
(45) Date of Patent: Mar. 28, 2023

(54) METHOD AND APPARATUS FOR OPTIMIZATION OF BINAURAL BEAT

(71) Applicant: Min Joo Choi, Jeju-si (KR)

(72) Inventors: Min Joo Choi, Jeju-si (KR); Seong Chan Kim, Jeju-si (KR); Geum Na Hong, Jeju-si (KR)

(73) Assignee: Min Joo Choi, Jeju-si (KR)

( * ) Notice: Subject to any disclaimer, the term of this patent is extended or adjusted under 35 U.S.C. 154(b) by 0 days.

(21) Appl. No.: 16/870,463

(22) Filed: May 8, 2020

(65) Prior Publication Data

US 2021/0345059 A1 Nov. 4, 2021

(30) Foreign Application Priority Data

May 4, 2020 (KR) ..... 10-2020-0053321

(51) Int. Cl.

| | |
|---|---|
| ***H04S 7/00*** | (2006.01) |
| ***H04S 1/00*** | (2006.01) |
| ***H04R 3/04*** | (2006.01) |
| ***H04R 5/04*** | (2006.01) |

(52) U.S. Cl.

CPC ..... *H04S 7/304* (2013.01); *H04S 1/007* (2013.01); *H04S 2400/13* (2013.01)

(58) Field of Classification Search

None

See application file for complete search history.

(56) References Cited

U.S. PATENT DOCUMENTS

2010/0239096 A1* 9/2010 Jeon ..... H04S 1/002 381/1
2011/0105938 A1* 5/2011 Hardt ..... A61B 5/486 600/544
2012/0250895 A1* 10/2012 Katsianos ..... H03G 9/005 381/107
2013/0202119 A1* 8/2013 Thiede ..... H04R 25/552 381/23.1

(Continued)

FOREIGN PATENT DOCUMENTS

KR 1020130137018 A 12/2013
KR 1020150003104 A 1/2015

(Continued)

OTHER PUBLICATIONS

Seong Chan Kim and Min Joo Choi, "Changes in binaural beat strength to the difference of right and left hearing ability", 2019 Spring Academic Conference and 34th Hydroacoustic Conference, May 9-10, 2020.

(Continued)

*Primary Examiner* — Qin Zhu

(74) *Attorney, Agent, or Firm* — Rabin & Berdo, P.C.

(57) ABSTRACT

An apparatus for optimizing a binaural beat according to an embodiment of the present invention includes: a binaural beat generator that generates a binaural beat; and a binaural beat controller that optimizes the binaural beat in consideration of a hearing state of left and right ears of a listener. A method for optimizing a binaural beat according to an embodiment of the present invention includes: generating a binaural beat; and optimizing the binaural beat in consideration of a hearing state of left and right ears of a listener.

3 Claims, 5 Drawing Sheets

(56) References Cited

U.S. PATENT DOCUMENTS

| | | | | |
|---|---|---|---|---|
| 2013/0216055 | A1* | 8/2013 | Wanca | H03G 5/005 381/61 |
| 2015/0071448 | A1* | 3/2015 | Mesfin | H04R 25/552 381/23.1 |
| 2015/0296288 | A1* | 10/2015 | Anastas | H04R 5/033 381/77 |
| 2016/0205489 | A1* | 7/2016 | Jabri | H04S 5/00 381/17 |
| 2019/0030277 | A1* | 1/2019 | Espi Maques | G10K 11/17837 |
| 2021/0021947 | A1* | 1/2021 | Kao | G10L 21/0364 |
| 2021/0337312 | A1* | 10/2021 | Grillotti, Jr. | H04R 5/04 |

FOREIGN PATENT DOCUMENTS

| | | | |
|---|---|---|---|
| KR | 101590046 | B1 | 2/2016 |
| KR | 101659410 | B1 | 9/2016 |
| KR | 101858928 | B1 | 5/2018 |

OTHER PUBLICATIONS

Seong Chan Kim and Min Joo Choi, "Changes in binaural beat strength to the difference of right and left hearing ability", The Journal of the Acoustical Society of Korea, vol. 39, No. 1, pp. 57-63 (2020).

* cited by examiner

METHOD AND APPARATUS FOR OPTIMIZATION OF BINAURAL BEAT

CROSS REFERENCE TO RELATED APPLICATION

This patent application claims the benefit of Korea Patent Application No. 10-2020-0053321 filed May 4, 2020 with the Korean Intellectual Property Office, which is incorporated by reference herein in its entirety.

TECHNICAL FIELD

The present invention relates to a method and an apparatus for optimizing a binaural beat used to induce brain waves of a listener.

BACKGROUND ART

When the human hearing organs hear sounds with slightly different frequencies in both ears, the brain detects a beating phenomenon at a frequency corresponding to a difference between the frequencies of the two sounds. Binaural beats are sounds that do not actually exist and are the third sounds felt through the listener's hearing nerve. Binaural beats are used to induce brain waves in specific areas by using the beating phenomenon detected through the hearing nerve. This effect is the basis for the use of binaural beats to activate brain waves at specific frequencies in meditation or healing programs.

The binaural beat is a sound felt through the hearing nerve, and it is difficult to quantitatively measure the binaural beat and the magnitude of the beating can be checked only from the listener's opinion. The magnitude of the sound perceived by the listener is greatly influenced by the individual hearing condition, so the optimized sound varies depending on the listener. However, a binaural beat is currently used without considering a listener's hearing state.

It is estimated that the intensity of the binaural beat felt through the hearing organs is different if the hearings of the left and right ears are different even when the same sound is heard in both ears. Recently, research and technology development using a binaural beat have been conducted, but a method of optimizing the binaural beat according to the listener's hearing state has not been proposed.

DESCRIPTION OF THE INVENTION

Technical Problem

The problem to be solved by the present invention is to provide a method for optimizing a binaural beat in consideration of the listener's hearing state when using the binaural beat to induce brain waves.

Technical Solutions

An apparatus for optimizing a binaural beat according to an embodiment of the present invention includes: a binaural beat generator that generates a binaural beat; and a binaural beat controller that optimizes the binaural beat in consideration of a hearing state of left and right ears of a listener.

The binaural beat controller may optimize the binaural beat by adjusting left and right volume according to a difference in left and right hearings of the listener.

The binaural beat controller may optimize the binaural beat so that the listener feels left and right sounds at the same level when the listener listens to the generated binaural beat.

The hearing state of the left and right ears of the listener may include a difference in hearings of the left and right ears, and the difference in the hearings of the left and right ears of the listener may be estimated from a difference in a magnitude of a sound source that compensates hearing of the listener so that volumes of sound heard in both ears are the same.

The binaural beat controller may optimize the binaural beat by setting the magnitude of a sound source that compensates the hearing of the listener so that the volumes of the sounds heard from both ears of the listener are the same, thereby inducing the maximum binaural beat.

The binaural beat generator may generate the binaural beat by generating sound source to be heard in both ears using a reference frequency, a sound lever and a binaural beat frequency selected by the listener or a user.

The binaural beat generator may generate the binaural beat using a sound source that gives a tone according to a specific purpose or adds a preferred musical element to a background sound source.

A method for optimizing a binaural beat according to an embodiment of the present invention includes: generating a binaural beat; and optimizing the binaural beat in consideration of a hearing state of left and right ears of a listener.

In the optimizing, the binaural beat may be optimized by adjusting left and right volume according to a difference in left and right hearings of the listener.

In the optimizing, the binaural beat may be optimized so that the listener feels left and right sounds at the same level when the listener listens to the generated binaural beat.

The hearing state of the left and right ears of the listener may include a difference in hearings of the left and right ears, and the difference in the hearings of the left and right ears of the listener may be estimated from a difference in a magnitude of a sound source that compensates hearing of the listener so that volumes of sound heard in both ears are the same.

In the optimizing, the binaural beat may be optimized by setting the magnitude of a sound source that compensates the hearing of the listener so that the volumes of the sounds heard from both ears of the listener are the same, thereby inducing the maximum binaural beat.

In the generating, the binaural beat may be generated by generating sound source to be heard in both ears using a reference frequency, a sound lever and a binaural beat frequency selected by the listener or a user.

In the generating, the binaural beat may be generated using a sound source that gives a tone according to a specific purpose or adds a preferred musical element to a background sound source.

Effects of the Invention

According to the present invention, when using a binaural beat, an effect of hearing a binaural beat similar to an effect obtained in a listener having a normal hearing state can be achieved through optimization of a binaural beat according to the hearing state of various listeners.

DETAILED DESCRIPTION OF THE EMBODIMENTS OF THE INVENTION

Hereinafter, embodiments of the present invention will be described in detail with reference to the accompanying drawings.

Figure 1:
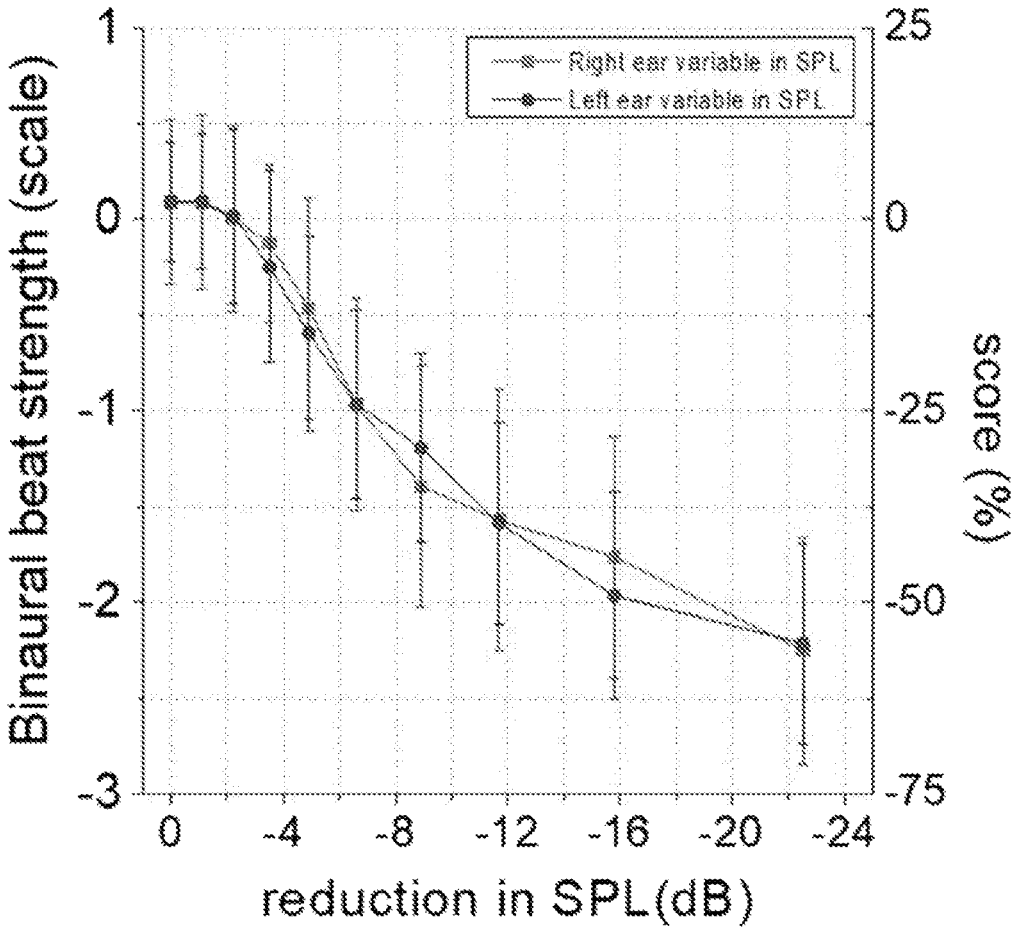
FIG. 1 is a graph showing a magnitude of a binaural beat felt by a listener when there is a difference in the amount of left and right sounds felt by a listener.

FIG. 1 is a graph showing a magnitude of a binaural beat felt by a listener when there is a difference in the amount of left and right sounds felt by a listener. FIG. 1 shows the change in the strength of the binaural beat felt by 34 listeners using the SDM (Semantic Differential Method) evaluation tool when a difference in a magnitude of left and right sounds increases while reducing the magnitude of a presented sound compared to a reference sound. In FIG. 1, the horizontal axis represents the amount of reduction of the sound pressure level (SPL) of the presented sound compared to the reference sound in dB, and the left vertical axis shows the change in the relative strength of the binaural beat. The right vertical axis shows a percentage (0% to 100%) of the range of 0 to −4 of the evaluation tool scale. The experiments were repeatedly performed while a reference sound was separately provided to the left ear and the right ears, and in FIG. 1 the positions of the reference sound and the presented sound heard in the opposite ear are shown separately. The strength of the binaural beat was found to be greatest when there was no difference in the magnitudes of the reference sound and the presented sound, that is, when there was no difference in the magnitudes of the left and right sounds. When a difference in a magnitude of the left and right sounds is small, the strength of the binaural beat remains similar at the beginning, but when the difference in the sound pressure level of the left and right sounds becomes to be greater than 2.2 dB, the strength of the binaural beat starts to decrease significantly and decreases rapidly if the difference in sound pressure level of the left and the right sounds becomes to be greater than 4.9 dB.

Figure 2:
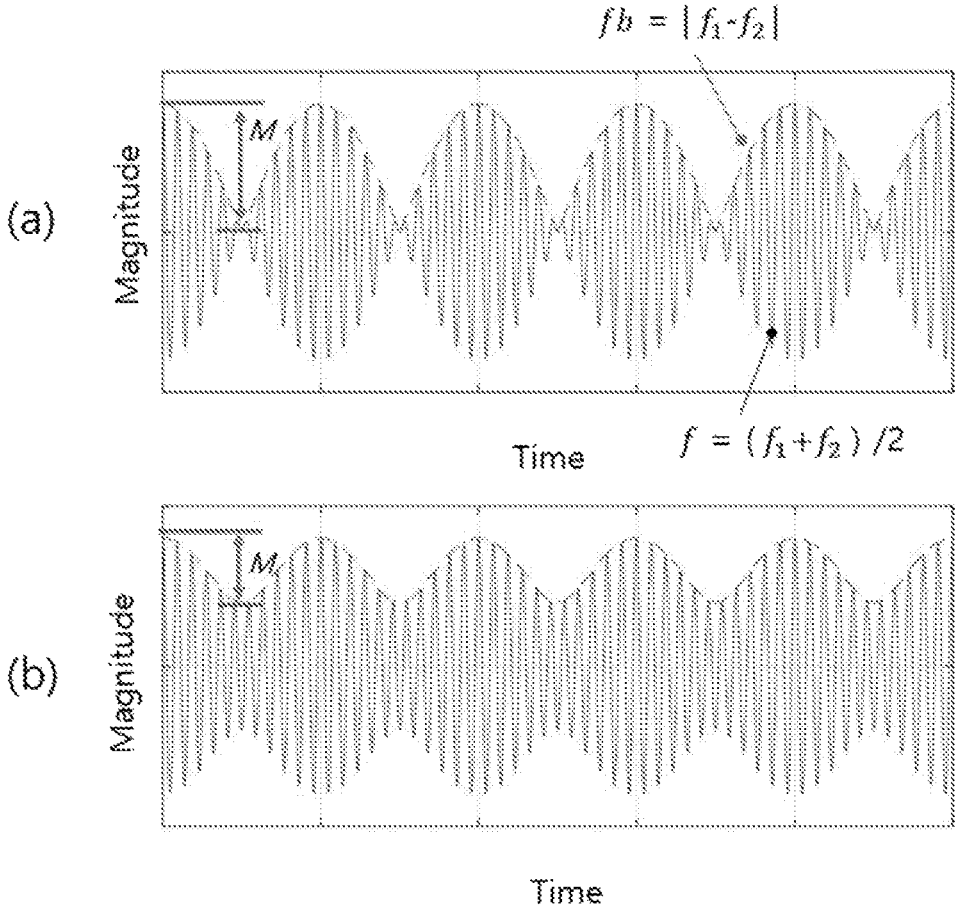
FIG. 2 is a graph showing an intensity or a magnitude of a beating that is visualized as a depth of an envelope in a beating signal in which signals of two sounds having different frequencies are combined.

FIG. 2 shows typical beating signals composed of two sound sources having amplitudes of $A_1$ and $A_2$ and frequencies of $f_1$ and $f_2$, respectively. FIG. 2 (*a*) shows the case where the amplitudes of two sound sources are the same (i.e., $A_1=A_2$), and FIG. 2 (*b*) shows the case where the amplitude of one sound source is half the amplitude of the other sound source (i.e., $A_1=A_2/2$). The binaural beating frequency $f_b$ corresponds to the difference between the two frequencies, and the oscillating frequency f is an average of the two frequencies. The beat magnitude (M) is defined as the depth of the envelope of the beating. Referring to FIG. 2 (*a*), the strength of the beating is greatest in comparison with the magnitudes of two sounds when the magnitudes of two sounds having different frequencies are the same. On the other hand, referring to FIG. 2 (*b*), as the difference between the magnitudes of the two sounds forming the beating increases, the strength of the beating decreases relatively. For this reason, the strength of the binaural beat perceived subjectively is also expected to be greatest when the magnitudes of the sounds provided to both ears are the same. It is also estimated that the strength of the binaural beat felt through the hearing organs will be different if the hearings of the left and right ears are different even if the same sound is heard in both ears.

An apparatus and a method for optimizing a binaural beat according to an embodiment of the present invention optimizes the binaural beat by reflecting the listener's left and right hearing states in consideration of the above-mentioned points. The left and right hearing states may include a difference in left and right hearings, and an apparatus and a method for optimizing the binaural beat according to an embodiment of the present invention may optimize the binaural beat by reflecting the difference in left and right hearings of the listener.

Figure 3:
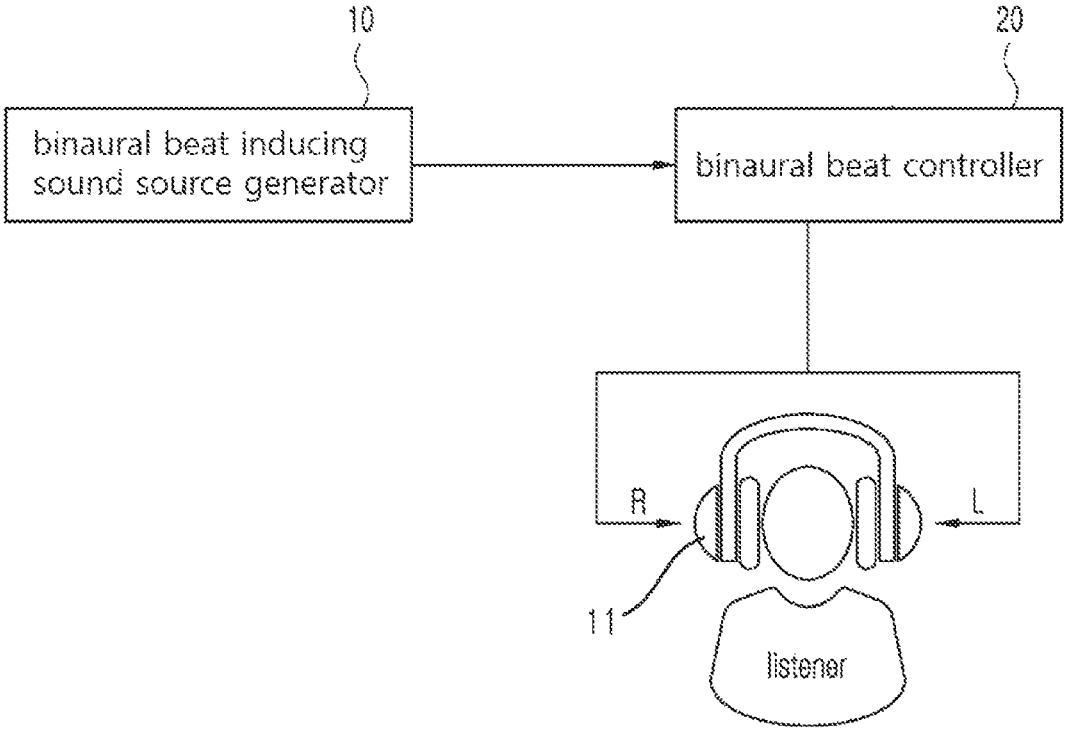
FIG. 3 is a conceptual block diagram of an apparatus for optimizing a binaural beat according to an embodiment of the present invention.

FIG. 3 shows a conceptual block diagram of an apparatus for optimizing a binaural beat according to an embodiment of the present invention. The binaural beat generator 10 generates a binaural beat, and the binaural beat controller 20 receives the generated binaural beat and optimizes the binaural beat by reflecting the difference in left and right hearings of the listener. The binaural beat controller 20 may optimize the binaural beat by adjusting the volume balance of the left and right sound sources.

Figure 4:
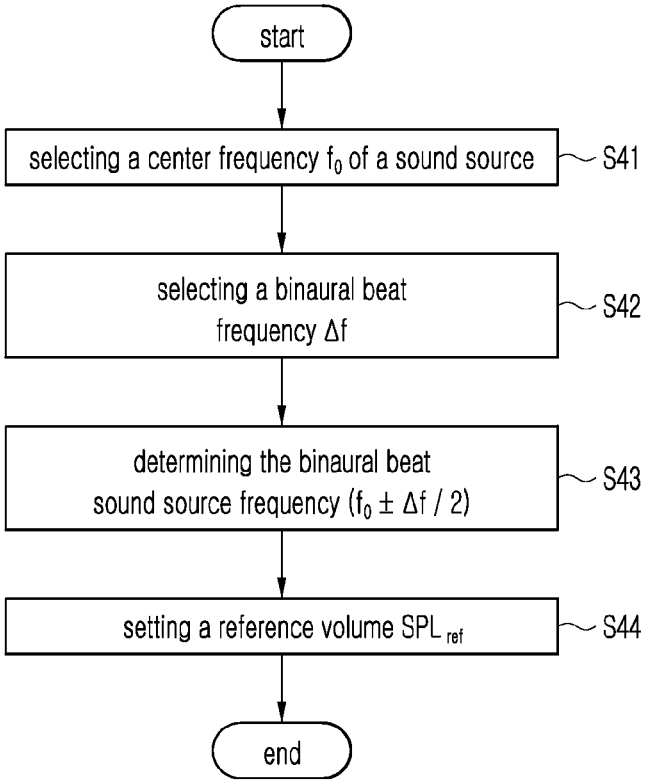
FIG. 4 is a flowchart illustrating a binaural beat generation process performed by a binaural beat generator of a binaural beat optimization apparatus according to an embodiment of the present invention.
Figure 5:
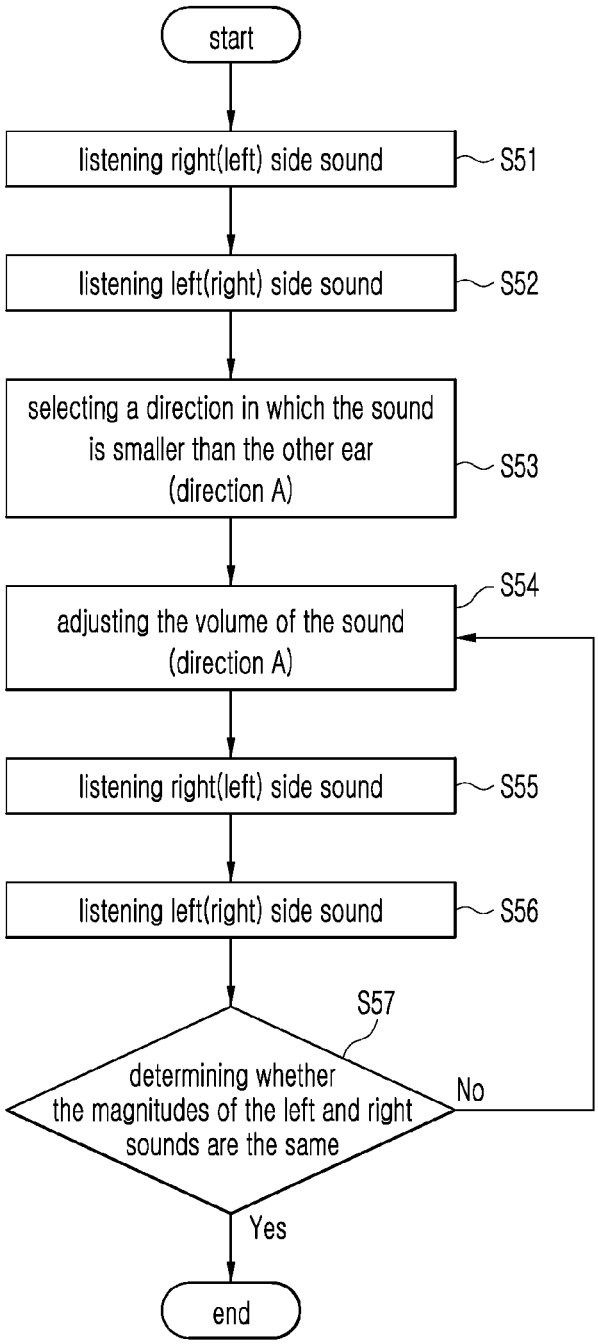
FIG. 5 is a flowchart illustrating a binaural beat adjustment process performed by a binaural beat controller of a binaural beat optimization apparatus according to an embodiment of the present invention.

FIG. 4 shows a flowchart showing a binaural beat generation process performed by the binaural beat generator 10 of the apparatus for optimizing the binaural beat according to an embodiment of the present invention, and FIG. 5 shows a flowchart showing a binaural beat adjustment process performed by the binaural beat controller 20 of the apparatus for optimizing the binaural beat according to the present invention. Hereinafter, a method for optimizing a binaural beat will be described with reference to FIG. 4 and FIG. 5.

The binaural beat generator 10 may generate a binaural beat using a reference frequency, a binaural beat frequency and a reference volume, which are basic information determined by a user. Here, the reference volume may be set to correct a volume sensitivity, a preference difference, and the like for each listener. The binaural beat controller 20 adjusts the magnitude of the binaural beat generated by the binaural beat generator 10. For example, the binaural beat controller 20 may adjust the binaural beat to maximize the strength of the binaural beat so that the listener who hears a sound source divided into left and right feels the same sound magnitude in both ears.

Specifically, referring to FIG. 4, the binaural beat generator 10 selects a center frequency $f_0$ of a sound source to be heard by a listener (S41). For example, the listener may select a desired center frequency through the input interface, and the binaural beat generator 10 may set the frequency selected by the listener as the center frequency.

The binaural beat generator 10 selects the binaural beat frequency Δf (S42). For example, the listener may select a desired binaural beat frequency through the input interface, and the binaural beat generator 10 may set the frequency selected by the listener as a binaural beat frequency. For example, the binaural beat frequency may be selected as 10 Hz.

The binaural beat generator 10 determines the binaural beat sound source frequency ($f_0 \pm \Delta f/2$) using the center frequency $f_0$ and the binaural beat frequency Δf (S43). As a result, two binaural beat sound source frequencies are determined.

The binaural beat generator 10 sets a reference volume $SPL_{ref}$ (S44). For example, the listener may select a reference volume he wants through an input interface, and the binaural beat generator 10 may set the volume selected by the listener as a reference volume.

The binaural beat generator 10 may generate two binaural beat sound sources to be provided to the left and right ears through the above process, and the two sound sources have the same reference volume but respectively have different frequencies having a difference corresponding to the binaural beat frequency value.

Meanwhile, the binaural beat generator 10 may generate a binaural beat using a sound source that gives a tone according to a specific purpose or adds a preferred musical element to a background sound source.

FIG. 5 shows a flowchart showing a control process for optimizing the binaural beat performed by the binaural beat controller 20.

The binaural beat controller 20 hears two binaural beat sound sources generated by the binaural beat generator 10 in the right and left ears (S51, S52).

The listener who hears the binaural beat sound sources with both ears selects the direction in which the sound in one ear is smaller than the sound in the other ear (S53).

The binaural beat controller 20 adjusts the volume of the sound of the corresponding ear after receiving information about the small-sounding ear selected by the listener (S54). At this time, the binaural beat controller 20 may increase the sound of the binaural beat sound source on the side where the sound is smaller.

Subsequently, the binaural beat controller 20 provides again the binaural beat sound source having the adjusted magnitude of sound source to the right and left ears (S55, S56).

Subsequently, the listener listens to two binaural beat sources through both ears, judges whether the magnitudes of the left and right sounds are the same and inputs the result. The binaural beat controller 20 determines whether the magnitudes of the left and right sounds are the same based on the information input by the listener (S57).

If it is determined in step S57 that the magnitude of the right and left sound levels are the same, the binaural beat controller 20 determines that the sound magnitude is properly adjusted according to a difference in hearing between the left and right ears of the listener, and the adjusted binaural beat sound source is provided to the listener. On the other hand, if it is determined in step S57 that the right and left sound levels are not the same, the binaural beat controller 20 repeats steps S54, S55 and S56 again to further adjust the sound magnitude.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for optimizing a binaural beat comprising:

a binaural beat inducing sound source generator that generates a sound source for allowing a listener to feel a binaural beat; and a binaural beat controller that controls a binaural beat effect in consideration of a hearing state of left and right ears of the listener, wherein the binaural beat inducing sound source generator comprises a sound transmitting device that makes sounds independently to left and right ears of the listener by making direct contact with the left and right ears of the listener respectively, wherein the binaural beat inducing sound source induces a binaural effect by generating a sound source to be heard by the left and right ears by the listener in response to a selection of a volume of the sound and a binaural beat frequency selected by the listener or a user, and generates the binaural beat by generating a sound source to be heard in both ears using a reference frequency, a sound level and a binaural beat frequency selected by the listener or the user;

wherein the binaural beat controller optimizes the binaural beat by adjusting volumes of sounds heard by the listener in the left and right ears according to a difference in left and right hearings of the listener, wherein the binaural beat controller optimizes the binaural beat so that the listener feels left and right sounds at a same level, and wherein the hearing state of the left and right ears of the listener comprises a difference in hearings of the left and right ears, and wherein the difference in the hearings of the left and right ears of the listener is estimated from a difference in a magnitude of a sound source that compensates hearing of the listener so that volumes of sound heard in both ears are the same.

2. The apparatus of claim 1, wherein the binaural beat inducing sound source generator generates the binaural beat using a sound source that gives a tone according to a specific purpose or adds a preferred musical element to a background sound source.

3. The apparatus of claim 1, wherein the binaural beat inducing sound source generator induces the binaural beat effect to the listener using a sound source that gives a tone according to a specific purpose or adds a preferred musical element to a background sound source.

* * * * *